US005109210A

United States Patent [19]

Boudet et al.

[11] Patent Number: 5,109,210

[45] Date of Patent: Apr. 28, 1992

[54] THERMAL RELAY WITH REMOTE CONTROLLED RESETTING AND TESTING JUNCTIONS

[75] Inventors: Pierre Boudet, Cergy; Manuel Lima, Paris; Frédéric Noirot, Marly le Roi, all of France

[73] Assignee: Telemecanique, France

[21] Appl. No.: 680,724

[22] Filed: Apr. 4, 1991

[30] Foreign Application Priority Data

Apr. 6, 1990 [FR] France ..... 90 04418

[51] Int. Cl.[5] ..... H01H 37/00; H01H 71/16; H01H 61/00

[52] U.S. Cl. ..... 337/2; 337/3; 335/6; 335/145

[58] Field of Search ..... 337/1, 2, 3, 71, 72, 337/37, 90, 91; 335/1, 6, 14, 18, 20, 26, 27, 145

[56] References Cited

U.S. PATENT DOCUMENTS

| | | | |
|---|---|---|---|
| 4,688,011 | 8/1987 | Lemmer et al. | 335/6 |
| 4,825,096 | 4/1989 | Fabrizi et al. | 335/6 |
| 4,859,979 | 8/1989 | Jacquet | 337/3 |
| 4,990,875 | 2/1991 | Lemarquand et al. | 335/14 |

*Primary Examiner*—Harold Broome
*Attorney, Agent, or Firm*—William A. Drucker

[57] ABSTRACT

A thermal relay is disclosed which can be remotely re-set and/or tripped by means of remote control electromagnets.

The case of the relay has second fixing means adapted to receive first fixing means belonging to one and the same electromagnet can in which an extension of the core or plate is orientable so as to come opposite each of the re-setting and testing pushers placed on the front face of the relay.

5 Claims, 4 Drawing Sheets

FIG. 1
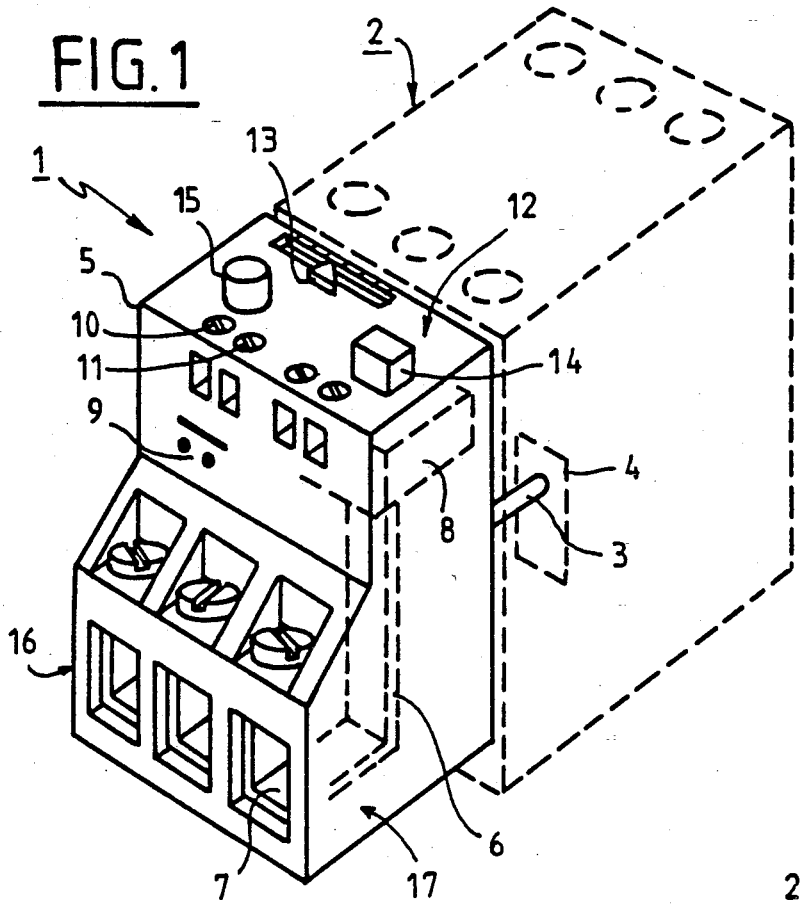
FIG. 3
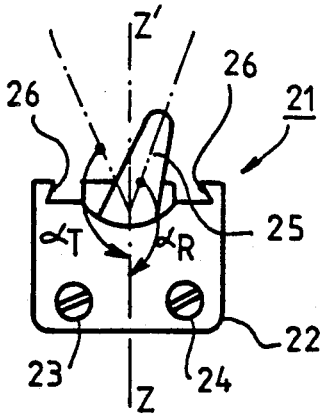
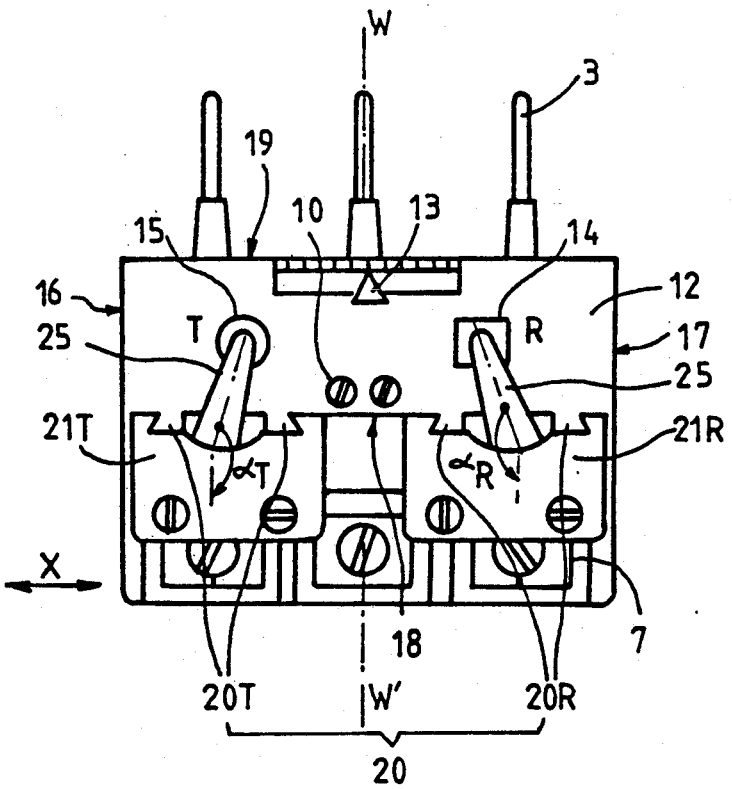
FIG. 2

THERMAL RELAY WITH REMOTE CONTROLLED RESETTING AND TESTING JUNCTIONS

BACKGROUND OF THE INVENTION

1. Field of the Invention

The invention relates to a thermal relay belonging to a range of relays, each comprising in a case current monitoring means capable, when overloads appear, of tripping an armed mechanism and opening a safety switch, and having on a front face of this case :

on the one hand, a first pusher for re-setting the mechanism after tripping, and on the other hand, a second pusher for artificially opening this safety switch during a testing procedure, whereas remote control means, comprising electromagnets each having a casing capable of being mechanically associated with the case, each have an actuating member such as a movable plate, a movable armature or a movable core adapted to drive in these pushers.

2. Description of the Prior art

Such relays and eleotromagnets, which are known for example from the Telemecanique catalogue 1987-1988, pages 3/128 and 3/129 of the Applicant, find their application in all the fields where an industrial installation comprises for instance a control and testing desk or post, where information is centralized relative to the appearance of operating faults, and from where electric signals may be emitted for establishing or re-establishing in desired time the start-up of apparatus such as motors, when the conditions for correct operation are brought together again.

For remote re-setting and tripping, the prior art apparatus comprises two separate electromagnets which are each able to carry out one of the above mentioned two operations; the size and the fixing means for the casings of these two electromagnets are such that they cannot be positioned simultaneously. The result is that centralization of the controls for the two above functions cannot be completely provided and that further an additional technical cost must be ascribed to the existence of two separate electromagnet models furthermore requiring separate storage volumes.

SUMMARY OF THE INVENTION

The invention proposes consequently improving any one of the thermal relays, whose construction is that mentioned above, for overcoming the deficiencies and reducing the technical cost thereof, by providing only a single type of electromagnet able to be simply adapted to each of the functions and to be mounted either singly or in pairs.

According to the invention, the aim sought is attained because :

said case comprises means for fixing two electromagnet casing on said front face, the actuating member of each of the electromagnets is orientable with respect to its can, the two pushers are disposed so as to be able to be actuated by the suitably oriented actuating members of two electromagnets fixed on said front face, without interference between these two elements.

BRIEF DESCRIPTION OF THE DRAWINGS

The invention as well as constructional variants to which it lends itself, will be better understood from the following description with reference to the accompanying figures which show :

FIG. 1, a simplified perspective view of a thermal relay without remote control means;

FIG. 2, a view of the front face of a thermal relay in accordance with the invention, and with the case of which two remote control electromagnets are associated;

FIG. 3, a view of a remote control electromagnet used in the invention;

DESCRIPTION OF THE PREFERRED EMBODIMENTS

Figure 4:
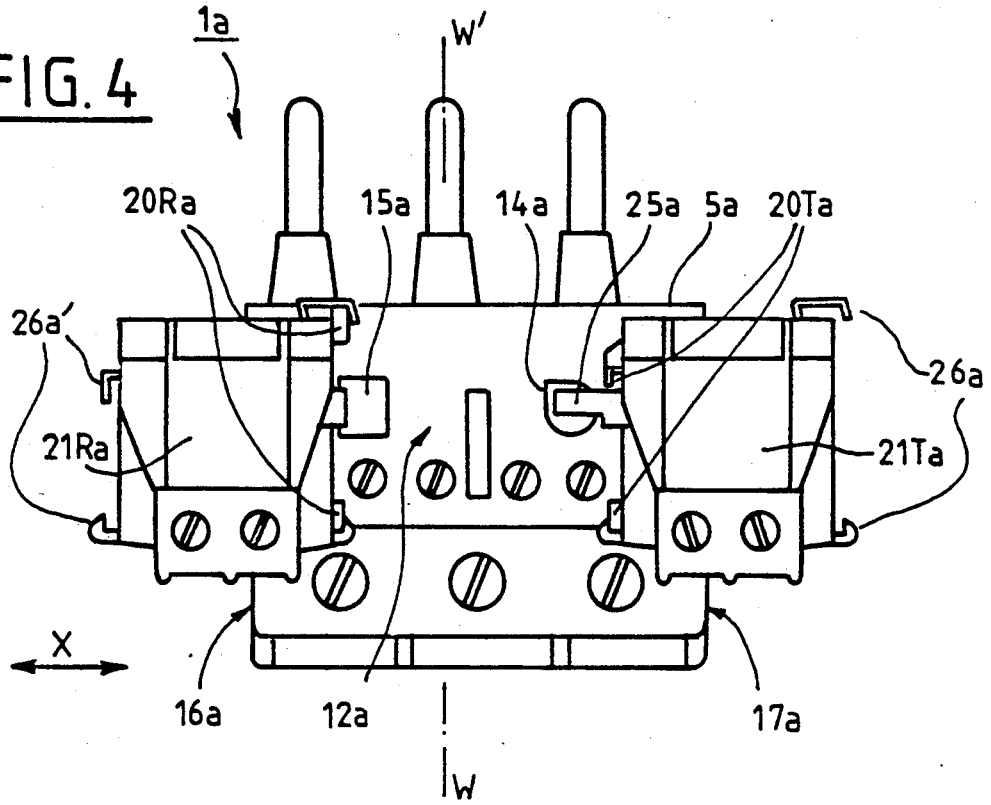
FIG. 4, a front view of a second thermal relay embodiment.

A usual thermal relay 1 is intended to be mechanically and electrically associated with a contactor apparatus 2 shown with broken lines in FIG. 1. The electric connections are usually provided by means of pins of the relay such as 3 penetrating into terminals of the contactor such as 4 and by means of hooks not shown.

The case of each of the relays of the range 5 of relays for mounting on contactor 2 contains essentially a set of thermal bi-metallic strips such as 6 which are each placed in series between a pin 3 and a terminal of the case such as 7, a tripping mechanism 8 which is released by deflection of the two or three bi-metallic strips, when the network is three-phase, and at least one safety switch 9 which is opened by tripping the mechanism. This switch, whose terminal screws 10, 11 can be seen on the front face 12 of the case is normally placed in series with the coil of the electromagnet of the contactor.

This same face generally receives a means for adjusting the tripping intensity 13, a re-setting button 14 for re-setting the mechanism when it has been tripped by a small but prolonged current overload and a test button 15 which is designed to cause voluntary opening of the safety switch, independently of the state of the bi-metallic strips. These buttons, which are generally of the pusher type returned by a spring, will be designated as such hereafter, whether they are embedded, flush or projecting with respect to this front face.

In the prior art, a single lateral face 16 or respectively, 17 of the case had hooking means for fixing the casing of a small control electromagnet, in which an extension of the plate, of the armature or of the plunger core was positioned opposite one of the two pushers; in order to reduce the size, only one of these lateral faces was used and the length of the extensions necessary for reaching the pusher concerned, as well as the differences of force to be overcome or of servicing time, justified the use of two separate electromagnets.

Referring to FIG. 2, in which the elements common to those shown above bear the same references, it can be seen that a face 18, distinct from the front face 12, and substantially parallel to face 19 carrying pins 3, has first fixing means 20 which are divided into a pair of separate fixing means 20R and 20T.

Each pair of means 20R, 20T which has been shown here in the form of dovetails, may have any shape, location and dimensions for receiving a small electromagnet can such as 21R, respectively 21T.

The arrangement shown, which is non limiting, is that which provides the minimum transverse dimension in direction X.

The two electromagnets 21R, 21T are in fact two small identical electromagnets 21 disposed in an insulating casing 22 which has two connection terminals 23, 24 and, in the case illustrated, a plunger core which is movable and angularly orientable 25, see FIG. 3.

As casing be better seen in FIG. 3, each small can 22 has first fixing means 26, which are adapted to cooperate with one of the pairs of second fixing means so as to secure it firmly to the case on each of the opposite faces 16*a*, 17*a*. The respective arrangement of the second means 20 on this case allows one, the other or both small electromagnets to be fixed, so that the user can benefit either from the two remote controlled functions : simple re-setting R, or simple testing T or both simultaneously.

For this, the pushers 14, 15 have been disposed on the case and the armature or movable armature extension 25 has thus been made orientable in direction αR, αT with respect to the casing 22 of the electromagnet, so that by a simple manipulation the corresponding function can be conferred thereon, the extensiors then coming opposite the corresponding pushers 14, 15 without reciprocal interference.

Taking into account the separate travel distances and forces required for driving in the pushers, it is clear that for carrying out one of the two functions R, T, the electromagnet 21 may be more voluminous than it would be for carrying out that one of these two driving in operations requiring a lesser travel distance and force than those required for carrying out the other function.

A situation may also arise, in which it is desired to provide great accessibility for the terminals such as 7 and 10, and where lateral projections in direction X may be tolerated. Considering the required adaptation of the geometrical shapes and dimensions of the case to its contents, it is also conceivable that not only face 16 and face 17 do not have identical configurations, but further that pushers 14, 15 are not disposed on the face 12 symmetrically with respect to a central axis WW' of a case 5*a* of a thermal relay 1 respectively la, see FIG. 4.

When such a situation occurs, case 5*a* may for example have fixing means 20T*a* and 20R*a* of different forms which are closer to the lateral faces 16*a*, 17*a*, see FIG. 4.

Figure 5:
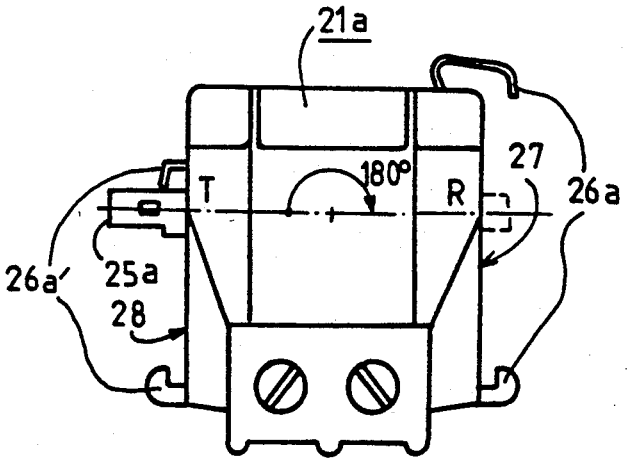
FIG. 5, a front view of a variant of form of the electromagnet used with a thermal relay according to FIG. 4.

The integral construction 21*a* of the remote control electromagnet 21T*a*, 21R*a* may, in this case, make it necessary to have pairs of first fixing means such as 26*a*, 26*a'* which may be of different forms and be disposed on opposite sides or faces 27, 28 of the electromagnet 21*a* for cooperating with second means 20T*a*, 20R*a* disposed respectively on opposite faces 16*a*, 17*a* of case 5*a*, see FIGS. 4 and 5.

Figure 6:
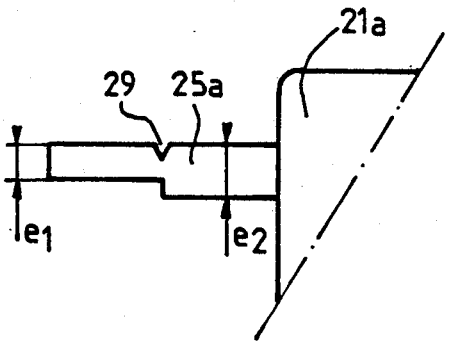
FIG. 6, a side view of a detail of a remote control electromagnet used in the relay of FIG. 4.

If, as mentioned above, the pushers 14*a*, 15*a* are disposed disymmetrically with respect to the axis WW' of the case, the lengths of the plates or of their extensions 25*a* may be distinct so as to avoid interferences, either between them or with particular regions of the front face 12*a*; a neat way of solving the problem raised by the need to comply with such distinct lengths, consists in making the plate extension 25*a* cleavable, for example through the presence of a judiciously placed notch 29, see FIG. 6. To further accommodate possible differences of travel distance, this extension may either be given a certain flexibility, or else it may be given different thicknesses e1, e2 so as to provide free travel, or play, between it and the pusher opposite which it will be positioned.

One of the further advantages of this embodiment is the fact that the armature extension 25*a* pivots here through 180° so as to carry out each of the two functions R or T, so that confusion at the time of associating the electromagnet with the case of the relay is avoided more than it would be with the preceding embodiment in which the orientation differences of the plates are much more reduced.

In order to take advantage of the above described embodiments, each of the thermal relays of the range has, despite different sizes of case, constructive arrangements and localization of the pushers with respect to the fixing means which are identical so that not only identical remote control electromagnets may be used in the way described above, but this facility further extends to each of the thermal relays of the range of products concerned.

Figure 7:
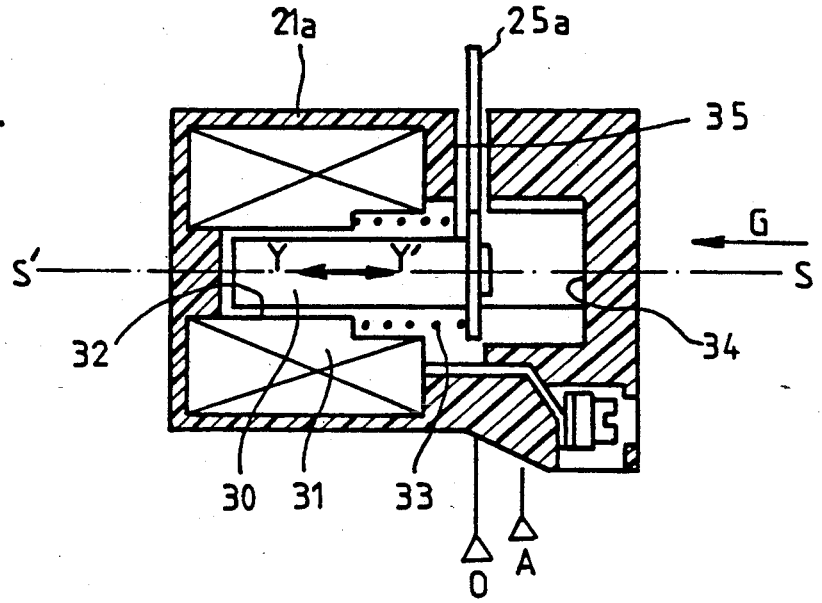
FIG. 7, an elevational and sectional view through the axis of the coil of a remote control electromagnet.
Figure 8:
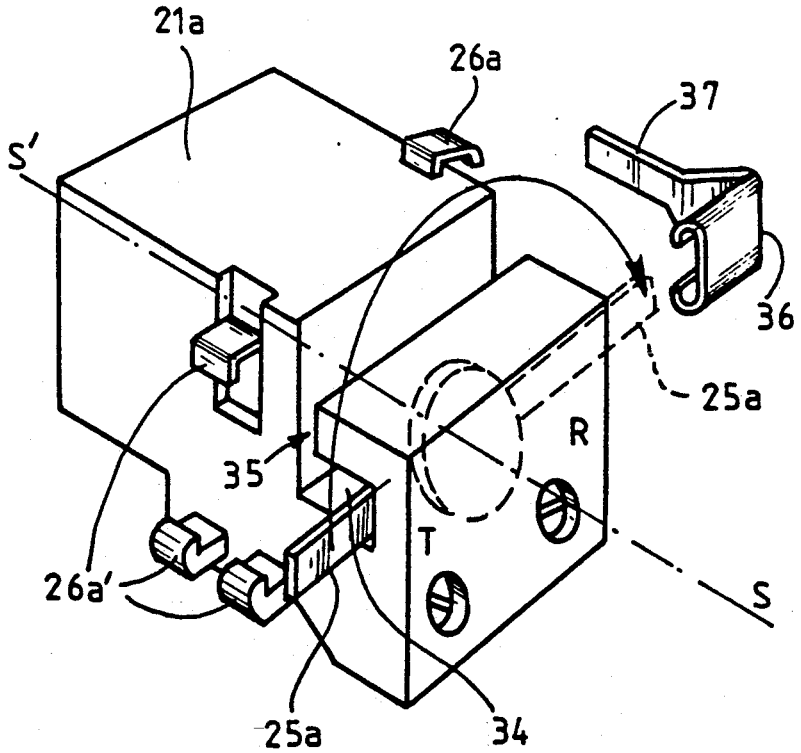
FIG. 8, a perspective view of the electromagnet shown in FIG. 7.

The electromagnet 21*a* illustrated in FIG. 5 is better seen in FIGS. 7 and 8 in which it can be seen that the extension 25*a* of core 30 also serves as gripping means for providing the desired orientation by rotating it about its axis SS' in a cylindrical cavity 32 of the coil 31 where it is subjected to the action of a return spring 33.

A guide groove 34 in the casing serves for guiding the movements in direction YY' of an extension 25*a* which is for example riveted to the core and which is subjected to the action of the return spring.

This guide groove opens into a slit 35 of the casing whose plane is perpendicular to SS' and opposite which the extension is positioned, in position -O-, when a manual pressure is exerted in direction G, beyond the magnetic attraction position -A-.

When the extension is originally in the -R- function position and in this -O- adjustment axial position, clockwise pivoting through 180° is communicated manually thereto, as can be seen in FIG. 8, then the extension is released so that the return spring returns it to the opposite region of groove 34.

The -R- function electromagnet has thus become a -T- function electromagnet.

In this same Figure, it can be seen how the extension 25 may, as an option, be provided with a clippable lug 36 having a finger 37 bent at 90°. This lug is used for reaching for example a test pusher which is embedded in the case of the thermal relay, or which is flush with the front face thereof.

Figure 9:
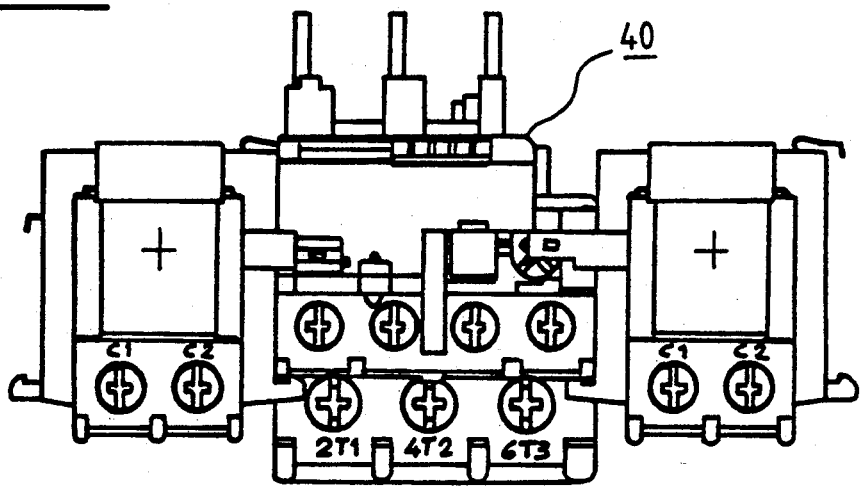
FIGS. 9 and 10, two front views of different sizes of thermal relays with which remote control electromagnets are associated.
Figure 10:
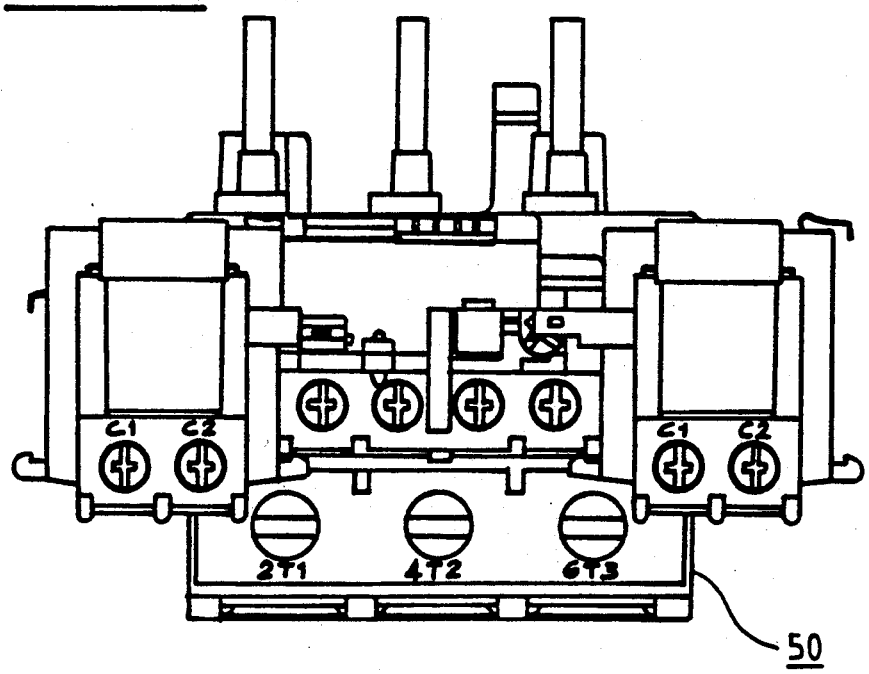

Different sizes of thermal relays 40, 50 receiving the same remote control electromagnets are, for example, illustrated in FIGS. 9 and 10.

What is claimed is:

1. A thermal relay comprising a switching module comprising in a case thermal bimetallic strips responsive to the occurrence of an overload, a tripping mechanism cooperating with said thermal bimetallic strips, a safety switch actuated by said tripping mechanism and first and second pushers passing through a front face of the case, said first pusher being used for re-setting the mechanism after tripping and said second pusher controlling an artificial opening of the safety switch during a testing procedure, said case being provided with first and second means for removably fixing on said front face first and second remote control modules each comprising an electromagnet having a coil and a movable armature coupled to an angularly orientable actuating member which may be oriented in a first angular position so as to be able to actuate the first pusher and in a second angular position so as to be able to actuate the second pusher.

2. The thermal relay as claimed in claim 1, wherein each remote control module has a first fixing element able to cooperate with two second fixing elements provided on a same face of the case.

3. The thermal relay as claimed in claim 1, wherein each remote control module has a pair of first fixing elements and the case comprises two second fixing elements provided on two opposite faces of the case.

4. The thermal relay as claimed in claim 1, wherein a core-plunger extension of the electromagnet makes movements of magnetic attraction an resilient release in a predetermined direction in a groove of the remote control module and this core may reach a position beyond the magnetic attraction position so as to place said extension opposite a slit of the remote control module which is perpendicular to said predetermined direction, and opens into this groove so as to allow pivoting thereof about an axis common to the core and to the coil.

5. The thermal relay as claimed in claim 1, wherein said first and second means for fixing said remote control modules have dimensions which are independent from the size of the thermal relay.

* * * * *